United States Patent [19]

Kindig et al.

[11] 4,175,924

[45] Nov. 27, 1979

[54] TREATMENT OF COAL WITH METAL CONTAINING COMPOUNDS

[75] Inventors: James K. Kindig, Arvada; Ronald L. Turner, Golden, both of Colo.

[73] Assignee: Hazen Research, Inc., Golden, Colo.

[21] Appl. No.: 767,352

[22] Filed: Feb. 10, 1977

[51] Int. Cl.[2] ..... C10L 9/10; C10B 57/00

[52] U.S. Cl. ..... 44/15 R; 201/17

[58] Field of Search ..... 44/1 R; 201/17

[56] References Cited

U.S. PATENT DOCUMENTS 3,938,966 2/1976 Kindig et al. ..... 44/1 R

*Primary Examiner*—Carl Dees

*Attorney, Agent, or Firm*—Sheridan, Ross, Fields & McIntosh

[57] ABSTRACT

Raw coal is improved by reacting it with a metal containing compound selected from the group consisting of organic iron containing compounds which exert sufficient vapor pressure, with iron as a component in the vapor, so as to bring the iron into contact with the impurity at the reaction temperature, organic iron containing compounds in solution at the injection temperature, solid organic iron containing compounds capable of being directly mixed in solid form at the mixing temperature with the coal, and ferrous chloride, ferric chloride, and alkyl aluminum compounds, in order to enhance the magnetic susceptibility of certain impurities, e.g., pyrite and ash-forming minerals contained in the raw coal, thereby permitting the removal of these impurities by magnetic means.

20 Claims, No Drawings

TREATMENT OF COAL WITH METAL CONTAINING COMPOUNDS

BACKGROUND OF THE INVENTION

1. Field of the Invention

The process of the present invention relates to the improvement of the properties of coal, and is classified generally in the class relating to fuels and igniting devices.

2. The Prior Art

With the present world-wide emphasis on the energy crisis and the rapidly diminishing sources of oil, increased attention by both government and private organizations is being given to coal as a source of energy, especially for the generation of electricity. This country has vast resources of coal for development as other sources of energy diminish.

Depending upon their origin, coals contain varying amounts of iron disulfide (iron disulfide is hereinafter referred to as pyrite whether crystallized as pyrite or marcasite) from which sulfur dioxide is formed as a combustion product when coal is burned. This is a tremendous disadvantage to the use of coal as an energy source, particularly in view of the current emphasis on pollution controls as illustrated by present federal emission control standards for sulfur dioxide. Illustrating the enormity of the sulfur dioxide emission problem is the fact that large transportation expenses are incurred by coal users in transporting Western and European coal of relatively low sulfur content long distances to supplant available high sulfur-containing coals in order to comply with sulfur dioxide emission standards. At this time there are not effective means available which are commercially feasible for absorbing the large amounts of sulfur dioxide emitted by the combustion of coal to produce heat and electricity. One solution of the problem is to separate the sulfur-bearing pyrite from the coal before it is burned.

Coals also contain, depending upon their origin, various amounts and kinds of minerals which form ash when the coal is burned. The ash also is a disadvantage to the use of coal as an energy source, since it contributes no energy value during combustion. The ash causes a dilution of the calorific value of the coal, and causes a waste disposal problem and a potential air pollution problem.

The problem of separating pyrite and/or other impurities from raw coal is not new and a number of methods have been extensively tested over the years. Among these are methods which employ the difference in specific gravity between coal particles and the impurity particles or differences in their surface, electrostatic, chemical, or magnetic properties. For various reasons difficulties are encountered in making an efficient separation of pyrite or other impurities from coal which has been ground finely enough to substantially liberate impurity particles from coal particles. In water systems this difficulty is related to the slow settling rate of fine particles, and in air systems to the large difference in specific gravity between air and the particles. However, for magnetic separations the magnetic attraction force acting on small magnetic particles is many times greater than the opposing force, which is usually a hydraulic drag and/or gravity force.

For the separation of pyrite or other impurities from raw coal the success of a magnetic process is dependent upon some effective treatment process for selectively enhancing the magnetic susceptibility of the pyrite or other impurity. Coal particles alone are slightly diamagnetic while pyrite and many other mineral impurities are weakly paramagnetic; however, their paramagnetism has not been sufficient to economically effect a separation from coal. However, effective beneficiation of coals can be made if the magnetic susceptibility of pyrite or other impurities is increased. For pyrite it has been estimated that a sufficient increase in susceptibility can be achieved by converting less than 0.1 percent of pyrite in pyritic coal into ferromagnetic compounds of iron ("Magnetic Separation of Pyrite from Coals," Bureau of Mines Report of Investigations 7181, p.1).

In discussing the use of heat to enhance the paramagnetism of pyrite it is stated in the above report (p.1) that ferromagnetic compounds of iron are not formed in significant quantities at tempratures below 400° C., and that such conversion occurs in sufficient quantities to effect beneficiation only at temperatures greater than 500° C. As this is above the decomposition temperature of coal, the use of heat to enhance the magnetic susceptibility of impurities does not appear feasible. Further, other methods for enhancing the paramagnetism of pyrite to permit its separation from coal have not been encouraging.

U.S. Pat. No. 3,938,966 discloses a process for improving coal wherein the raw coal is reacted with substantially undecomposed iron carbonyl which alters the magnetic susceptibility of certain impurity components contained in the raw coal, thereby permitting their removal by low-intensity magnetic separators. This process represents a noteworthy advance in the art, as treating coal in accordance with this process may substantially remove impurities such as pyrite, a primary contributor to sulfur dioxide pollution problems. The process of this patent, however, does not appear to possess universal applicability with an equal degree of success in that while many coals are substantially enhanced by this treatment, certain other coals are not as receptive.

Iron carbonyls, particularly iron pentacarbonyl, are representative of an unusual class of compounds in which the metal is present in the zero valance state. This "zero valence iron" decomposition allows the iron to selectively react with various impurities contained within raw coal, while not affecting the coal itself. There appear to be several bases for such an unusual result, including the probability that active sites on the impurity particles accelerate the decomposition of iron carbonyl to metallic iron and carbon monoxide. Also it is likely that iron carbonyl reacts at temperatures near its decomposition temperature as if it were chemically free metallic iron vapor, a very reactive reducing agent.

It has been discovered by the inventors of the present application, however, that not only vaporized iron carbonyls are beneficial in effecting removal of impurities from raw coal, but that a wide variety of metal containing compounds, most of which contain metals existing in other than the zero valence state, can also be used on various coals to effect such a removal by magnetic separation.

SUMMARY OF THE INVENTION

The magnetic susceptibility of pyrite and other impurities in coal is selectively enhanced by treating the coal containing pyrite and/or other impurities with one or more metal containing compounds selected from the group consisting of organic iron containing compounds which exert sufficient vapor pressure, with iron as a component in the vapor, so as to bring the iron into contact with the impurity at the reaction temperature, organic iron containing compounds in solution at the injection temperature, solid organic iron containing compounds capable of being directly mixed in solid form at the mixing temperature with the coal, and ferrous chloride, ferric chloride, and alkyl aluminum compounds, under suitable operating conditions. After the coal is so treated, it is then passed through a magnetic separator for removal of the affected impurities.

DESCRIPTION OF THE PREFERRED EMBODIMENT

The process of the present invention can be applied to coals of universal origin, as long as the coal contains one or more impurities receptive to the metal treatment. The process employs a metal treatment in order to enhance the magnetic susceptibility of an impurity. By selectively enhancing this property of the impurity, while not affecting the coal itself, a magnetic separation may be conventionally accomplished to remove the impurity from the coal. The coal is therefore left in a more pure state, rendering it more suitable for combustion.

"Enhancing the magnetic susceptibility" of a particle or an impurity as used herein is intended to be defined in accordance with the following discussion. Every compound of any type has a specifically defined magnetic susceptibility, which refers to the overall attraction of the compound to a magnetic force. An alteration of the surface characteristics will alter the magnetic susceptibility. The metal treatment of the process alters the surface characteristics of an impurity in order to enhance the magnetic susceptibility of the impurity. It is to be understood that the magnetic susceptibility of the impurity is not actually changed, but the particle itself is changed, at least at its surface, resulting in a particle possessing a greater magnetic susceptibility than the original impurity. For convenience of discussion, this alteration is termed herein as "enhancing the magnetic susceptibility" of the particle or impurity itself.

The impurities with which the process of the present invention may be utilized include those impurities which react with one or more of the metal compounds hereinafter described to form a product possessing an enhanced magnetic susceptibility. Examples of such impurities include pyrite; ash-forming minerals, such as clays and shales; and various sulfates, for example, calcium sulfate and iron sulfate. For purposes of illustration the discussion hereinafter refers to pyrite, but it is to be understood that other suitable impurities may be effected in similar fashion.

Numerous metal containing compounds are suitable to impart this magnetic susceptibility. A number of different mechanisms are believed to be involved in what is termed herein as the "treatment" and/or magnetic susceptibility enhancement "reaction" depending upon the metal containing compound or compounds and the reaction conditions employed. Some metal containing compounds, with metals more magnetic than the impurities, principally iron, under certain conditions coat the impurity with the metal, thereby enhancing the magnetic susceptibility of the impurity. Some metal containing compounds affect the pyrite by combining with some of the pyrite sulfur to yield an iron sulfide more magnetic than pyrite. The following reaction exemplifies this mechanism:

$$6M + 7FeS_2 \rightarrow Fe_7S_8 + 6MS$$

Similarly, ash, such as $Fe_2O_3$, may react with a metal to form a more strongly magnetic compound, as for example, in accordance with the following reaction:

$$M + 3Fe_2O_3 \rightarrow MO + 2Fe_3O_4$$

Other mechanisms undoubtedly also contribute to the enhancing of the magnetic susceptibility, and again this is principally determined by the particular metal containing compound or compounds employed and the reaction conditions. It is to be understood that in view of the disclosures herein presented, the selection of a given metal compound, along with the most desirable reaction conditions to be employed with the given compound, cannot be itemized for each and every compound due to the number of variables involved. However, the proper selection will be apparent to one skilled in the art with but a minimal amount of experimentation, and it is sufficient to note that the improvement of the invention herein set forth relates to all of these compounds.

Many organic metal containing compounds possess the capability of enhancing the magnetic susceptibility of coal impurities, as long as the compound is adaptable so as to bring the metal in the compound into contact with the impurity under conditions such as to cause an alteration of at least a portion of the surface of the impurity. Organic metal containing compounds capable of exerting sufficient vapor pressure, with the metal as a component in the vapor, so as to bring the metal into contact with the impurity at the reaction temperature are suitable, as well as other organic metal containing compounds which can be dissolved and/or "dusted" (directly mixed with the coal) and brought into contact with the impurity.

Preferred compounds within the vapor pressure group are organic iron containing compounds which exert a vapor pressure as described above. Preferably these compounds exert a vapor pressure, with iron as a component in the vapor, of at least about 0.5 millimeters of mercury, more preferably at least about 25 millimeters of mercury, and most preferably at least about 50 millimeters of mercury at the reaction temperature. Examples of groupings which fall within this vapor pressure definition include ferrocene and its derivatives and $\beta$-diketone compounds of iron. Specific examples include ferrocene, dimethyl ferrocenedioate, 1,1'-ferrocenedicarboxylic acid, ferric acetylacetonate, ferrous acetylacetonate, acetyl ferrocene, ferrocene aldehyde, ferrocene carboxylic acid, $\alpha$-hydroxyethyl ferrocene, and 1,1'-dihydroxymethyl ferrocene.

Other organic compounds which may be utilized to enhance the magnetic susceptibility include those which may be dissolved and brought into contact with the impurities. These compounds must have sufficient solubility so as to provide sufficient metal to contact the surface of the impurity. Preferably the solubility is at least about 1 gram per liter, more preferably at least about 10 grams per liter, and most preferably at least about 50 grams per liter at the injection temperature. The solvent must, of course, possess the capability of dissolving the organic compounds within the above set forth concentrations, and preferably not create side reaction problems tending to detract from the effectiveness of the process. Suitable solvents include, for example, acetone, petroleum ether, naphtha, hexane, kerosene, and benzene. This is, of course, dependent upon the particular metal compound being employed.

Groupings which fall within this solution definition include the carboxylic acid salts of iron and β-diketone compounds of iron. Specific examples include iron octoate, iron naphthenate, iron stearate, ferric acetylacetonate, and ferrous acetylacetonate.

Additionally, solid organic iron containing compounds capable of being directly mixed with the coal in solid form possess the capability of enhancing the magnetic susceptibility of coal impurities. The compound must be in solid form at the mixing temperature and be of sufficiently fine particle size in order to be able to be well dispersed throughout the coal. The particle size is preferably smaller than about 20 mesh, more preferably smaller than about 100 mesh, and most preferably smaller than about 400 mesh. Compounds within this grouping include ferrocene and its derivatives, iron salts of organic acids, and β-diketone compounds of iron. Specific examples include ferrous formate, 1,1'-diacetyl ferrocene, and 1,1'-dihydroxymethyl ferrocene.

Several other compounds are also suitable for enhancing the magnetic susceptibility of various coal impurities to the exclusion of coal. These compounds include ferrous chloride, ferric chloride and alkyl aluminum compounds, such as triisobutyl aluminum. Ferric chloride and ferrous chloride may be injected by the direct mixing and/or solvent techniques as described hereinabove. The alkyl aluminum compounds are injected either by vaporizing external to the reaction vessel and allowing the vapor to pass over the heated coal, or by spraying the alkyl compound directly onto the heated coal. A carrier gas may be used as a convenience to help transfer the alkyl aluminum into the reaction chamber, but is not inherently required.

The process, as it relates to the vaporizable components described hereinabove, is applied by contacting the raw coal which is liberated from pyrite or other impurities with the metal containing compound under conditions such that there is an insufficient dissociation of the metal containing compound to cause substantial deposition of metal on the coal particles. These conditions are determined by the temperature, the type of metal containing compound, pressure, gas composition, etc. Ordinarily, a gas of the metal containing compound is heated to a temperature just below its decomposition temperature under the reaction conditions. Various types of available equipment can be used for contacting the metal containing compound and coal, such as a rotating kiln used as the reaction vessel with the metal containing compound vapors carried into contact with the tumbling contents of the kiln by a gas such as nitrogen. The treatment is performed by contacting the coal with the metal containing compound for a time of preferably from about one tenth to about four hours, and more preferably from about one half to about two hours; at a temperature of preferably from about 150° C. to about 325° C. and more preferably from about 175° C. to about 300° C., and at a concentration of preferably from about 2 to about 75 kilograms per metric ton of coal.

With respect to iron containing compounds, the process must be carried out at a temperature below the temperature of major decomposition of the metal containing compound under the reaction conditions such that there is opportunity for the metal of the compound to react with the impurity particles. If the temperature is above the decomposition temperature, the selectivity of the process of enhancing the magnetic susceptibility of one or more impurities without affecting the coal is impaired. The alkyl aluminum compounds are not bound by the requirement.

For efficient separations of pyrite from coal, the coal should be crushed to such fineness that pyrite particles are free, or nearly free, from the coal particles. The required fineness depends upon the size distribution of the pyrite in the coal. A thorough treatment of the subject for power plant coals is given in the article entitled "Pyrite Size Distribution and Coal-Pyrite Particle Association in Steam Coals," Bureau of Mines Report of Investigation 7231. The requirement for pyrite liberation applies to all types of physical separations and so is not a disadvantage of this invention. Additionally, present technology for coal-fired power plants generally required pulverizing the coal to 60–90 percent minus 200 mesh before burning.

Prior to treating the raw coal with a metal containing compound, the coal can be pretreated with heat or steam or pretreated to remove elemental sulfur in order to render the coal and impurities more receptive to the magnetic enhancement reaction. Methods of heat and steam pretreatment can be found in copending application Ser. No. 761,307, filed Jan. 21, 1977, and methods for the removal of elemental sulfur can be found in copending application Ser. No. 764,390, filed Jan. 31, 1977.

EXAMPLES

EXAMPLE 1

Samples of Pittsburgh Seam coal sized 14-mesh by 0 were treated with different iron compounds in a nitrogen atmosphere. The iron compounds were vaporized externally and then injected as a vapor into the reaction chamber as the coal was heated stepwise to the maximum temperature. The results along with the type and amount of iron compound are given in Table 1.

EXAMPLE 2

Several samples of Pittsburgh Seam coal sized 14-mesh by 0 were treated with various iron compounds applied either by wetting the coal with a solution and evaporating the solvent (S/E) prior to heating the coal, or by directly mixing the iron compound as a powder with the coal at room temperature (DM) prior to heating. The results are presented below in Table 2.

EXAMPLE 3

The results of treating Lower Freeport coal, sized 14-mesh by 0, with various iron compounds vaporized externally and then injected as a vapor into the reaction chamber while the coal was heated to the maximum temperature indicated are presented in Table 3. Samples 1–4 were first pretreated with steam for one hour at 200° C. with 192 kilograms of water per metric ton of coal. Samples 5 through 7 were first dried at a temperature of 130° C. for 30 minutes prior to the treatment with the iron compound.

Table 1

| Sample Number | Compound | Kg/Metric Ton | Maximum Temp,°C. | Time, Hours | Vapor Pressure mm Hg | Clean Coal Analysis Yield, Wt. % | Ash, % | Inorganic Sulfur, % |
|---|---|---|---|---|---|---|---|---|
| 1 | Ferrocene | 16 | 265 | 1 | >760 | 97.6 | 20.7 | 1.76 |
| 2 | Acetyl ferrocene | 12 | 270 | 1 | >50 | 96.2 | 21.1 | 1.59 |
| 3 | Ferrocene carboxylic acid | 7 | 255 | 1 | >50 | 95.9 | 20.9 | 1.62 |
| 4 | Ferrocene aldehyde | 10.1 | 265 | 1 | >100 | 97.2 | 20.4 | 1.74 |
| 5 | Dimethyl ferrocenedioate | 12.3 | 250 | 1 | >10 | 95.7 | 20.2 | 1.54 |
| 6 | Ferrous acetylacetonate | 10.5 | 275 | 1 | >50 | 93.6 | 19.1 | 1.73 |
| 7 | αHydroxyethyl ferrocene | 15.1 | 300 | 1 | >50 | 89.1 | 18.7 | 1.62 |
| 8 | Ferric acetylacetonate | 11 | 275 | 2 | >50 | 92.2 | 19.0 | 1.42 |
| 9 | Ferric cyclohexane butyrate | 11.2 | 300 | 2 | >10 | 90.6 | 18.7 | 1.55 |
| 10 | 1,1'-Ferrocene dicarboxylic acid | 12.4 | 300 | 1 | >1 | 70.8 | 18.7 | 1.24 |
| 11 | Dimethyl ferrocenedioate | 12.3 | 250 | 2 | >10 | 95.7 | 20.2 | 1.54 |
| 12 | Dimethyl ferrocenedioate | 12.5 | 275 | 1 | >10 | 79.4 | 18.2 | 1.71 |
| 13 | Ferrous acetylacetonate | 10.5 | 175 | 1 | >.5 | 91.0 | 19.3 | 1.78 |
| 14 | Ferric acetylacetonate | 13.5 | 170 | 1 | >.5 | 90.9 | 18.4 | 1.76 |
| | Feed (No Treatment) | — | — | — | — | 100.0 | 21.1 | 1.93 |

Table 2

| Sample Number | Compound | Kg/Metric Ton | Method of Application | Maximum Temp, °C. | Time, Hours | Clean Coal Analysis Yield, Wt. % | Ash, % | Inorganic Sulfur |
|---|---|---|---|---|---|---|---|---|
| 1 | Ferric Chloride | 68 | DM | 250 | 1 | 95.8 | 21.9 | 1.85 |
| 2 | Ferrous Chloride | 55 | S/E | 300 | 1 | 55.4 | 18.5 | 1.35 |
| 3 | 1,1'-Diacetyl ferrocene | 16 | DM | 255 | 1 | 82.5 | 15.3 | 1.93 |
| 4 | Ferrous acetylacetonate | 16.5 | S/E | 300 | 1 | 90.0 | 17.7 | 1.90 |
| 5 | Ferric acetylacetonate | 16 | S/E | 295 | 1 | 70.1 | 13.9 | 1.48 |
| | Feed (Untreated) | — | — | — | — | 100.1 | 21.1 | 1.93 |

Table 3

| Sample Number | Compound | Kg/Metric Ton | Maximum Temp, °C. | Vapor Pressure mm Hg | Clean Coal Analysis Yield, Wt. % | Ash, % | Inorganic Sulfur, |
|---|---|---|---|---|---|---|---|
| 1 | Ferrocene | 16 | 275 | >760 | 74.1 | 23.8 | 1.41 |
| 2 | Ferrocene carboxylic acid | 7.9 | 275 | >50 | 81.0 | 25.3 | 1.47 |
| 3 | Acetylferrocene | 13.0 | 275 | >50 | 77.2 | 22.7 | 1.41 |
| 4 | Dimethyl ferrocenedioate | 15.0 | 275 | >10 | 79.1 | 24.0 | 1.46 |
| 5 | Ferrocene carboxylic acid | 9.7 | 275 | 50 | 74.0 | 23.6 | 1.56 |
| 6 | Dimethyl ferrocenedioate | 15.6 | 275 | >10 | 67.8 | 24.2 | 1.49 |
| | Feed (Untreated) | — | — | — | 100.0 | 28.1 | 1.76 |

EXAMPLE 4

Samples of Lower Freeport coal, size 14-mesh by 0, were treated with ferric chloride and ferric acetylacetonate by dissolving these compounds in a volatile solvent which was mixed with the coal and allowed to evaporate prior to heating. Samples 1 and 2 were first pretreated with steam at 200° C. for one hour with 192 kilograms of water per metric ton of coal. Sample 3 was first dried at 130° C. for 30 minutes prior to being treated with the iron compound.

EXAMPLE 5

Pittsburgh Seam coal, size 14-mesh by 0, was treated with different iron compounds and either hydrogen at 200 milliliters per minute or carbon monoxide at 24 milliliters per minute for periods of time of about one hour. The conditions and results are presented in Table 5.

EXAMPLE 6

A 75-gram sample of Pittsburgh Seam coal, sized 14-mesh by 0, was pretreated with steam for one hour at 200° C. with 192 kilograms of water per metric ton of coal. Thereafter, it was treated with 5 milliliters of triisobutyl aluminum which was slowly vaporized and carried by 275 milliliters per minute of nitrogen into the reaction chamber as the coal was heated to 250° C. and maintained at this temperature for one hour. A blank run was conducted on an identical sample of coal, with the treatment gas consisting of nitrogen alone. A product analysis of this blank run is not provided as essentially none of this sample was enhanced in magnetic susceptibility.

Table 4

| Sample Number | Compound | Kg/Metric Ton | 15 min. @ Maximum Temp, °C. | Clean Coal Analysis Yield, Wt. % | Ash, % | Inorganic Sulfur, % |
|---|---|---|---|---|---|---|
| 1 | Ferric Chloride | 26.5 | 300 | 55.7 | 22.7 | 1.55 |
| 2 | Ferric Acetylacetonate | 16 | 285 | 75.1 | 22.4 | 1.31 |
| 3 | Ferric Acetylacetonate | 16.1 | 285 | 75.3 | 22.7 | 1.64 |
| | Feed (Untreated) | — | — | 100.0 | 28.1 | 1.76 |

Table 5

| Sample Number | Compound | Kg./ Metric Ton | Cotreatment Gas | Method of Application | Vapor Pressure, mm Hg | Max. Temp., °C. | Clean Coal Analysis Yield, Wt. % | Ash, % | Inorganic Sulfur, % |
|---|---|---|---|---|---|---|---|---|---|
| 1 | Hydroxyethyl ferrocene | 17.2 | $H_2$ | Inj. | >50 | 300 | 88.1 | 18.7 | 1.01 |
| 2 | Dimethyl ferrocenedioate | 17.9 | $H_2$ | Inj. | >50 | 300 | 87.9 | 18.7 | 1.22 |
| 3 | Dimethyl ferrocenedioate | 15.0 | CO | Inj. | >10 | 280 | 88.4 | 19.3 | 1.58 |
| 4 | Ferric acetylacetonate | 16 | CO | S/E | >100 | 300 | 81.8 | 17.2 | 1.78 |
| 5 | Ferric octoate | 16.3 | CO | S/E | >1 | 300 | 83.3 | 17.9 | 1.59 |
| 6 | Ferric octoate | 36.3 | $H_2$ | S/E | >1 | 275 | 46.0 | 9.2 | 0.69 |
| 7 | Ferrous formate | 32 | $H_2$ | DM | >1 | 250 | 92.2 | 20.8 | 1.42 |
| 8 | Ferric chloride | 68.9 | $H_2$ | DM | >50 | 275 | 86.7 | 21.3 | 1.30 |
| 9 | Ferrous chloride | 46.2 | $H_2$ | DM | >50 | 275 | 92.8 | 20.8 | 1.10 |
| 10 | Ferrous acetylacetonate | 16 | $H_2$ | S/E | >7.5 | 175 | 88.9 | 18.6 | 1.43 |
| 11 | Ferric acetylacetonate | 16 | $H_2$ | S/E | >100 | 300 | 45.7 | 13.1 | 1.23 |
| 12 | Ferric benzoylacetonate | 32 | $H_2$ | S/E | >5 | 275 | 87.7 | 17.6 | 1.25 |
| 13 | Ferrocene | 16 | CO | Inj. | >760 | 280 | 85.6 | 19.3 | 1.62 |
| 14 | Acetyl ferrocene | 16 | CO | Inj. | >50 | 280 | 89.8 | 19.2 | 1.55 |
| 15 | Ferrocene carboxylic acid | 8 | CO | Inj. | >50 | 280 | 86.6 | 19.4 | 1.76 |
| 16 | Ferrocene dicarboxylic acid | 7.5 | CO | Inj. | >1 | 280 | 87.5 | 19.4 | 1.55 |
| | Feed (Untreated) | — | — | — | — | — | 100.0 | 21.1 | 1.93 |

Table 6

| Description | Product | Yield Wt. % | Ash, % | Inorganic Sulfur, % |
|---|---|---|---|---|
| Triisobutyl aluminum | Clean coal | 90.8 | 20.4 | 1.56 |
| Blank | Clean coal | 99.2 | — | — |
| Feed | — | — | 20.3 | 1.93 |

What is claimed is:

1. A process for improving coal comprising treating raw coal with a metal containing compound selected from the group consisting of:

organic iron containing compounds which exert sufficient vapor pressure, with iron as a component in the vapor, so as to bring the iron into contact with the impurity at the reaction temperature;

organic iron containing compounds in solution at the injection temperature;

solid organic iron containing compounds capable of being directly mixed in solid form at the mixing temperature with the coal; and ferrous chloride, ferric chloride, and alkyl aluminum compounds; under conditions so as to enhance the magnetic susceptibility of various impurity components contained in the raw coal, thereby permitting their removal by magnetic separation.

2. The process of claim 1 wherein the metal containing compound comprises one or more organic iron containing compounds which exert a vapor pressure, with iron as a component in the vapor, of at least about 0.5 millimeters of mercury at the treatment temperature.

3. The process of claim 1 wherein the metal containing compound comprises one or more organic iron containing compounds which exert a vapor pressure, with iron as a component in the vapor, of at least about 25 millimeters of mercury at the treatment temperature.

4. The process of claim 2 wherein the organic iron containing compound is a member selected from the group consisting of ferrocene, ferrocene derivatives, and $\beta$-diketone compounds of iron.

5. The process of claim 4 wherein said organic iron containing compound comprises one or more members selected from the group consisting of ferrocene, dimethyl ferrocenedioate, 1,1'-ferrocenedicarboxylic acid, ferric acetylacetonate, ferrous acetylacetonate, acetyl ferrocene, ferrocene aldehyde, ferrocene carboxylic acid, $\alpha$-hydroxyethyl ferrocene, and 1,1'-dihydroxymethyl ferrocene.

6. The process of claim 1 wherein the organic iron containing compound is in solution at the injection temperature.

7. The process of claim 6 wherein the organic iron containing compound has a solubility of at least about 1 gram per liter of solvent at the injection temperature.

8. The process of claim 6 wherein the organic iron containing compound has a solubility of at least about 50 grams per liter of solvent at the injection temperature.

9. The process of claim 6 wherein the solvent is selected from the group consisting of acetone, petroleum ether, naphtha, kerosene, hexane, and benzene.

10. The process of claim 6 wherein the organic iron containing compound is one or more members selected from the group consisting of carboxylic acid salts of iron and $\beta$-diketone compounds of iron.

11. The process of claim 10 wherein said organic iron containing compound is a member selected from the group consisting of iron octoate, iron naphthenate, iron stearate, ferric acetylacetonate, and ferrous acetylacetonate.

12. The process of claim 1 wherein the metal containing compound comprises one or more solid organic iron containing compounds capable of being directly mixed in solid form at the mixing temperature with the coal.

13. The process of claim 12 wherein the particle size of said solid organic iron containing compound is less than about 20 mesh.

14. The process of claim 12 wherein said organic iron containing is one or more members selected from the group consisting of ferrocene and its derivatives, iron salts of organic acids, and $\beta$-diketone compounds of iron.

15. The process of claim 12 wherein said organic iron containing compound is selected from the group consisting of ferrous formate, 1,1'-diacetyl ferrocene, and 1,1'-dihydroxymethyl ferrocene.

16. The process of claim 1 wherein the metal containing compound is a member selected from the group consisting of ferrous chloride, ferric chloride and alkyl aluminum compounds.

17. The process of claim 16 wherein said alkyl aluminum compound is triisobutyl aluminum.

18. The process of claim 1 wherein the treatment is performed by contacting the coal with the metal containing compound for a time of from about one-half to about four hours.

19. The process of claim 1 wherein the treatment is performed by contacting the coal with the metal containing compound at a temperature of from about 150° C. to about 325° C.

20. The process of claim 1 wherein the treatment is performed by contacting the coal with the metal containing compound at a concentration of from about 2 to about 75 kilograms of metal containing compound per metric ton of coal.

* * * * *